United States Patent [19]

Horvath

[11] 4,228,990

[45] Oct. 21, 1980

[54] HYDRAULIC SEWER CLEANING SYSTEM

[76] Inventor: Steve Horvath, 915 W. Bluelick Rd., Lima, Ohio 45801

[21] Appl. No.: 954,999

[22] Filed: Oct. 26, 1978

[51] Int. Cl.[3] ..... F21C 29/16

[52] U.S. Cl. ..... 254/134.3 FT

[58] Field of Search ..... 15/104.3 SN, 104.3 R; 242/86.5 R, 86.6 R, 86.61, 158.2; 254/134.3 R, 134.3 FT, 134.3 PA, 190

[56] References Cited

U.S. PATENT DOCUMENTS

| | | | |
|---|---|---|---|
| 644,884 | 3/1900 | Wrigley | 254/134.3 R |
| 1,735,301 | 11/1929 | Short | 254/134.3 R |
| 2,221,903 | 11/1940 | Abramson et al. | 254/134.3 R |
| 3,218,033 | 11/1965 | Miller | 254/134.3 FT |
| 3,589,643 | 6/1971 | Takizawa | 242/158.2 |
| 3,934,854 | 1/1976 | Goode | 254/134.3 R |

*Primary Examiner*—Robert C. Watson

*Attorney, Agent, or Firm*—William Preston Hickey

[57] ABSTRACT

An improved system whereby a high pressure hydraulic hose can be unwound from a hose reel while under pressure, and moved laterally to a remote manhole, without manual restraint. The total system utilizes: an improved down the manhole sewer guide for the hose, a self-contained manhole feed frame which can be slid under the hose and which utilizes the pressure in the hose to lock it in place, a stationary rotary guide wheel positioned on one side of the hose reel, and an improved traverse mechanism which will accommodate lateral movement of the hose between the guide wheel and the hose reel.

6 Claims, 7 Drawing Figures

HYDRAULIC SEWER CLEANING SYSTEM

BACKGROUND OF THE INVENTION

Hydraulic sewer cleaning equipment of the type which utilizes a hydraulic reverse acting jet to feed a hose down the sewer has been commercially produced for approximately ten years. The hydraulic jet which issues from the nozzle cuts debris out of the sewer, and flushes it down the sewer away from the debris that is being cleaned. The equipment has generally utilized a hose reel for feeding out the hose under a pressure of more than a thousand pounds per square inch, and a down the manhole sewer guide which has required workmen to feed the hydraulic hose down the manhole in a direction parallel to the sewer being cleaned. Such equipment has not worked well when the hose has been fed laterally to the manhole. The reasons why this is true has not been readily assertainable, since the section of hose which enters the sewer is normally submerged in murky water which prevents visual observation. In addition, the prior art equipment has required a crew of men to operate. It has been necessary in instances where the manhole has been remotely located, to have one man uncoil the hose; another to pull the hose laterally and maintain it in a horizontal bowed condition; while a third man has been stationed at the manhole to feed the hose down the manhole in a direction parallel to the sewer being cleaned. The man stationed at the manhole has had to pull the hose with continuous physical effort while the hose is fed down the sewer; and it has been extremely difficult for the man located at the manhole to retrieve the hose while it is under pressure to produce a reverse cleaning action of the sewer.

Accordingly, it is an object of the present invention to provide a hydraulic sewer cleaning system which will service manholes that are remotely located from the hose reel with a minimum of manual effort and which can utilize the hose reel to slowly and precisely retrieve the hose under pressure to provide improved cleaning action.

Another object of the present invention is the provision of a new and improved down the manhole hose guide which overcomes binding of the hydraulic hose even when it is fed laterally into the manhole.

Another object of the present invention is the provision of a new and improved apparatus which, after the hose is strung down the manhole, can be put under the hose, then set on the top ring of the manhole in such manner that the hydraulic pressure in the hose will thereafter lock in its place.

Another object of the present invention is the provision of a new and improved means for retrieving the hose laterally from the manhole and for guiding it onto the hose reel.

Further objects and advantages of the invention will become apparent to those skilled in the art to which the invention relates from the following description of the preferred embodiments described with reference to the accompanying drawings.

DESCRIPTION OF THE PREFERRED EMBODIMENTS

Figure 1:
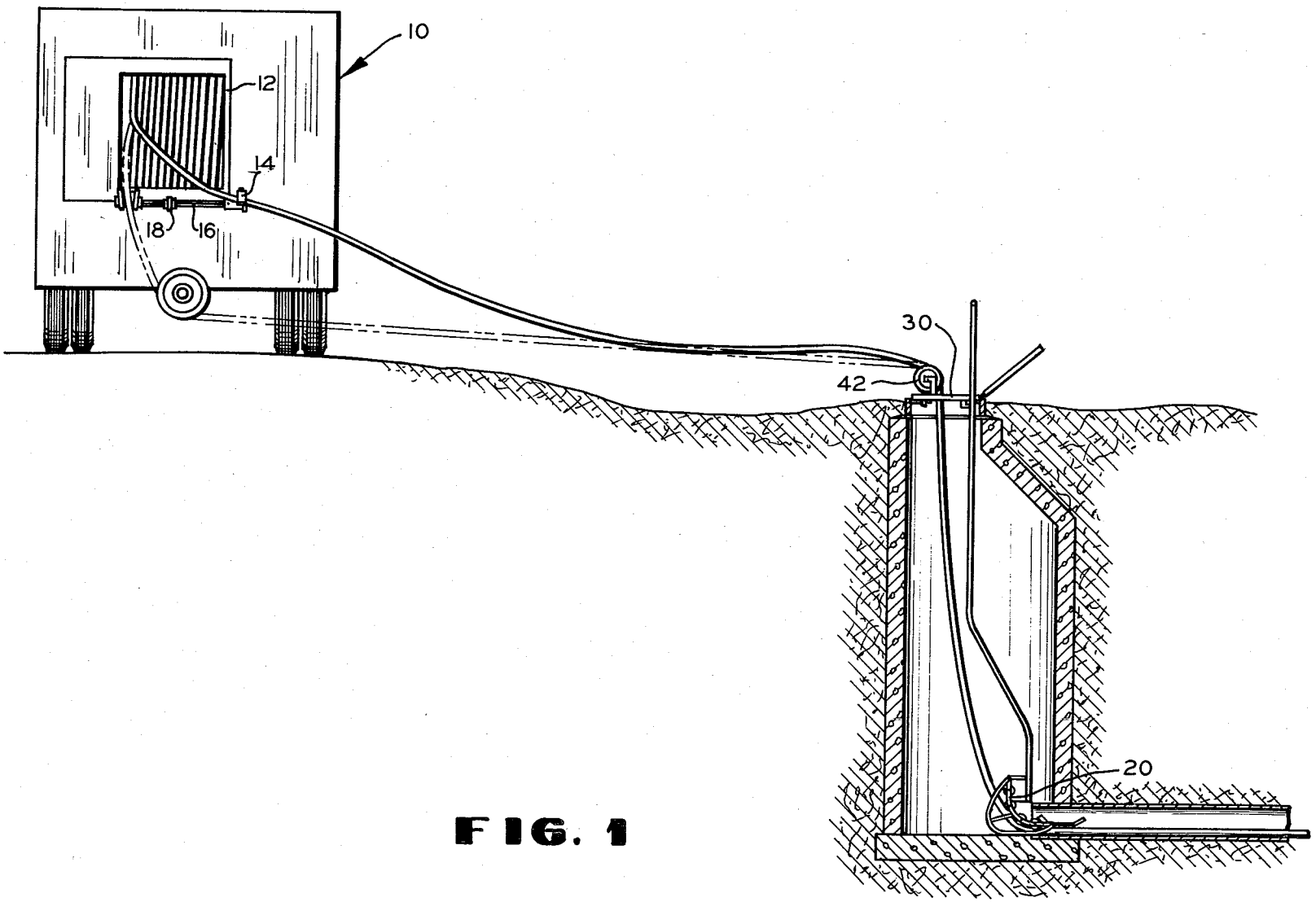
FIG. 1 is a schematic elevational view of the improved system of the present invention.

Although the improved hydraulic system of the invention may be otherwise embodied, it is herein shown and described as carried by a truck on which there is also mounted a water tank and hydraulic pump, not shown, to be used therewith. A hose reel 12 is mounted across the back of the truck on a transverse horizontal axis, so that the hose can be uncoiled in a direction parallel to the longitudinal axis of the truck. Suitable equipment, not shown, is provided for connecting the hose on the reel to the hydraulic pump, and for rotating the hose reel in either direction, by means of a power take off from the motor of the truck. The truck also contains a type of traverse mechanism 14 that is mounted on one end of an arm 16, the other end of which is suitably pivoted about a vertical axis to the back of the truck as at 18. The pivot 18 is located at approximately the longitudinal mid point of the hose reel, and is positioned slightly rearwardly of the hose reel, so that the hose will uncoil from the reel 12 in a sweeping arc while under pressure, and while being fed through the traverse mechanism 14. The prior art traverse mechanisms have employed rotatable cylindrically shaped pins for loosely confining the hose, and which allow movement from side to side in the traverse bracket. With this prior art mechanism, it has been possible, particularly when the hose is being fed out under pressure, for the hose to buckle between the hose reel and the traverse mechanism. In addition, it has been extremely difficult to move the traverse mechanism laterally with the hose under pressure.

In addition, the prior art has had a down the manhole sewer entrance guide having a frame which carries a series of rollers arranged to guide the hose along the bottom thereof in a 90 degree entrance bend for the sewer. The sewer entrance guide frame sat upon the hose and held it against the bottom of the sewer whenever the hose was in engagement with its rollers. The sewer entrance guide frame only extended below the bottom of the rollers by a single hose diameter, and since the lower end or the guide frame is submerged in murky water, the operation could not be observed when binding of the hose took place.

According to principles of the present invention, I have discovered that the sewer entrance guide should have a portion of its frame sitting on the bottom of the sewer to support the rollers above the bottom of the sewer by a distance that is greater than the diameter of the hose being fed into the sewer, and preferably at least one and one half hose diameters. Why this is necessary was not readily apparent, but since such a frame has had such a pronounced effect on the ease with which the hose is fed into the sewer and has eliminated the binding conditions which previously existed, it is theorized that the prior art hose guides have forced the hose down against the bottom of the sewer to locate the hose tight along the bottom arc of the sewer. It is theorized that pressure holds the section taunt against the bottom of the sewer from the point where it is confined between the lowermost roller and the bottom curvature of the sewer. It is believed that with the prior art guide, the hose did not conform to the rollers but extended out into the manhole where lateral force on the hose caused the hose to abut the sides of the frame and rotate it to thereafter keep the hose out of engagement with the rollers. Considerable difficulty has been experienced with the prior art devices in that the hose binds and does not feed into the sewer properly; and it is possible that the hose, when moved away from the rollers, even gets caught beneath the frame, particularly when the hose is fed laterally into the manhole. It has been thought by the prior art that the hose needed to be confined between the bottom of the sewer and the lowermost roller, and there has been no evidence to the contrary prior to the present invention.

I have made the discovery that the binding down in the manhole can be almost completely eliminated by providing feet on the frame of the sewer guide frame which raises the lowermost roller up off of the bottom of the sewer, so that the hose is not confined between the lowermost roller and the bottom of the sewer. Theoretically, tension on the hose should raise the guide clear of the bottom. Exactly how the feet correct the problem is not completely understood. In conjunction therewith, I provide a concave roller at the top of the manhole which will permit a controlled tensioning of the hose between the guide at the top of the manhole and the sewer guide at the bottom of the manhole. It is necessary that the hose be kept properly tensioned, and this is not always possible when it is manually fed into the upper end of the manhole opening.

Figure 2:
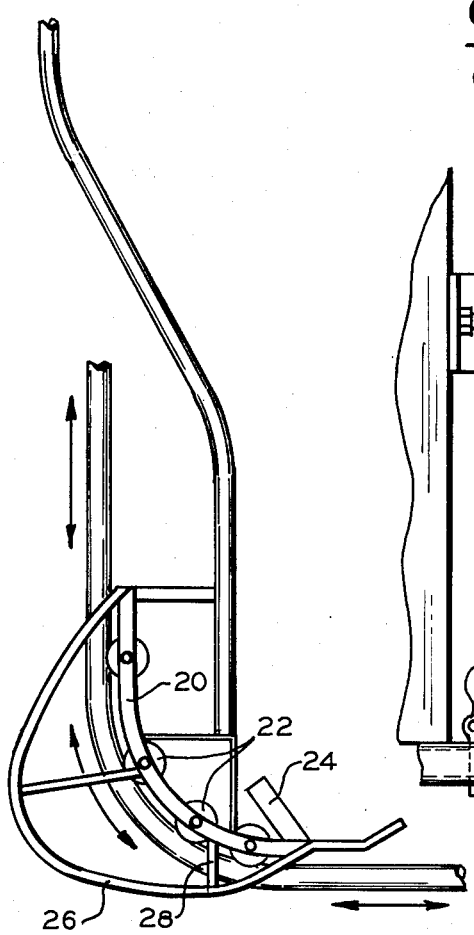
FIG. 2 is an enlarged fragmentary side view of an improved down the sewer hose guide capable of feeding the hose from the manhole into the sewer without binding regardless of the direction from which the hose is fed into the manhole.
Figure 5:
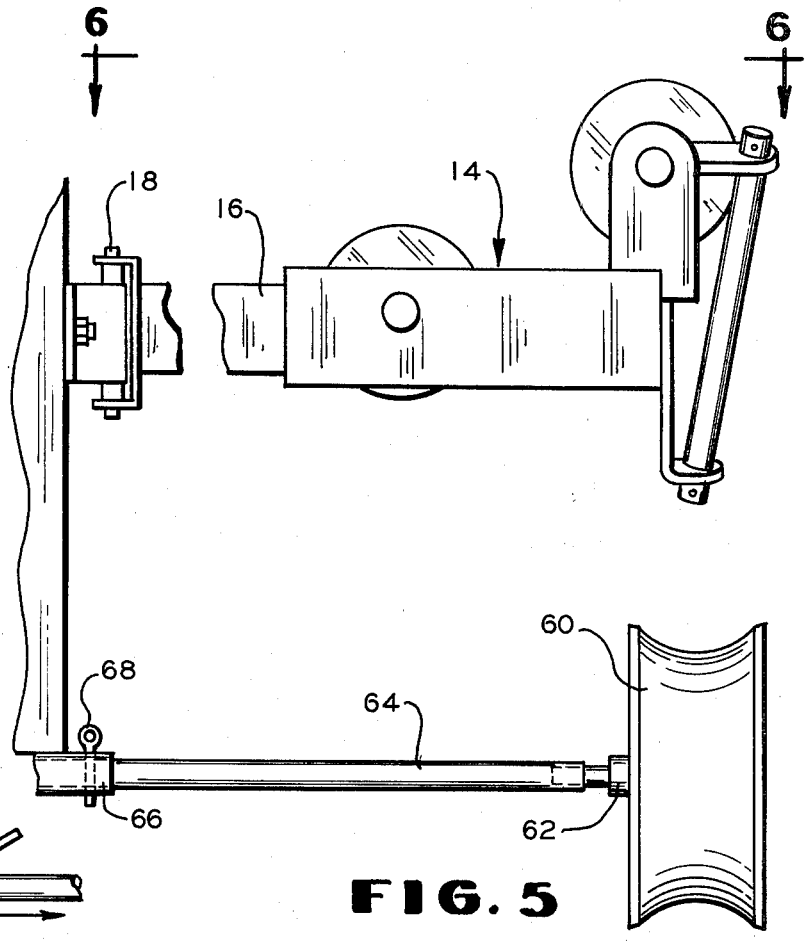
FIG. 5 is a side elevational view taken approximately on the line 5—5 of FIG. 1.
Figure 6:
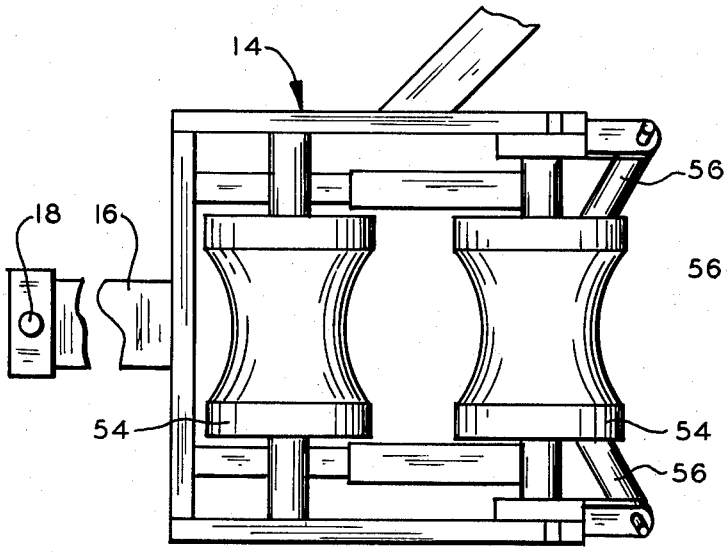
FIG. 6 is a plan view taken approximately on the line 6—6 of FIG. 5.
Figure 7:
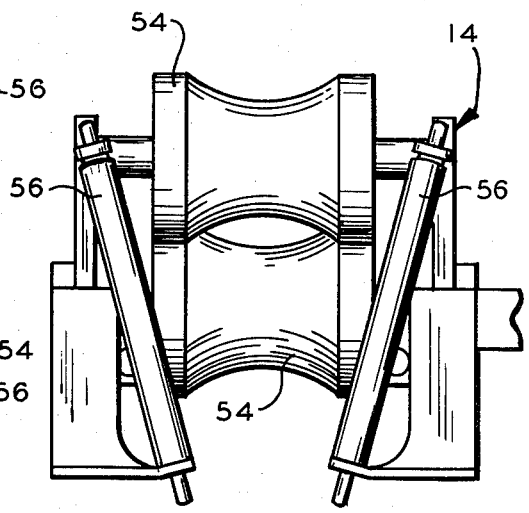
FIG. 7 is a side elevational view of FIG. 6.

FIGS. 1 and 2 of the drawings show a sewer entry guide constructed according to the principles of the present invention. The guide consists of a pair of arcuate upper frame members 20 having at least three, and preferably four, rollers 22 supported therefrom for horizontal rotation. The upper frame members 20 are positioned on opposite sides of the rollers, and their lower ends continue horizontally by a suitable distance for entering the sewer to be cleaned. The frame members 20 are connected together and are suitably held spaced apart at their lower end, as by U-shaped abutment 24 projecting from the top thereof to engage the top of a sewer when the frame is raised vertically into abutment therewith. The device also includes two arcuately shaped feet 26 which are connected at their upper ends to respective ones of the upper frame members 20. The feet 26 extend down below the lowermost roller 20 by a distance that is one and one half diameters of the hose with which it is to be used. This distance is maintained by a pair of appropriate spacers 28. The forward end of the feet 26, are, of course, connected to the forward end of the frame members 20, so that the feet 26 act as lateral guides for causing the hose to approach the center of the rollers as the hose slides down the feet toward the frame members 20. As previously indicated, the prior art devices had guides, but the prior art guides supported the lower roller at approximately one hose diameter above the bottom of the sewer.

Figure 3:
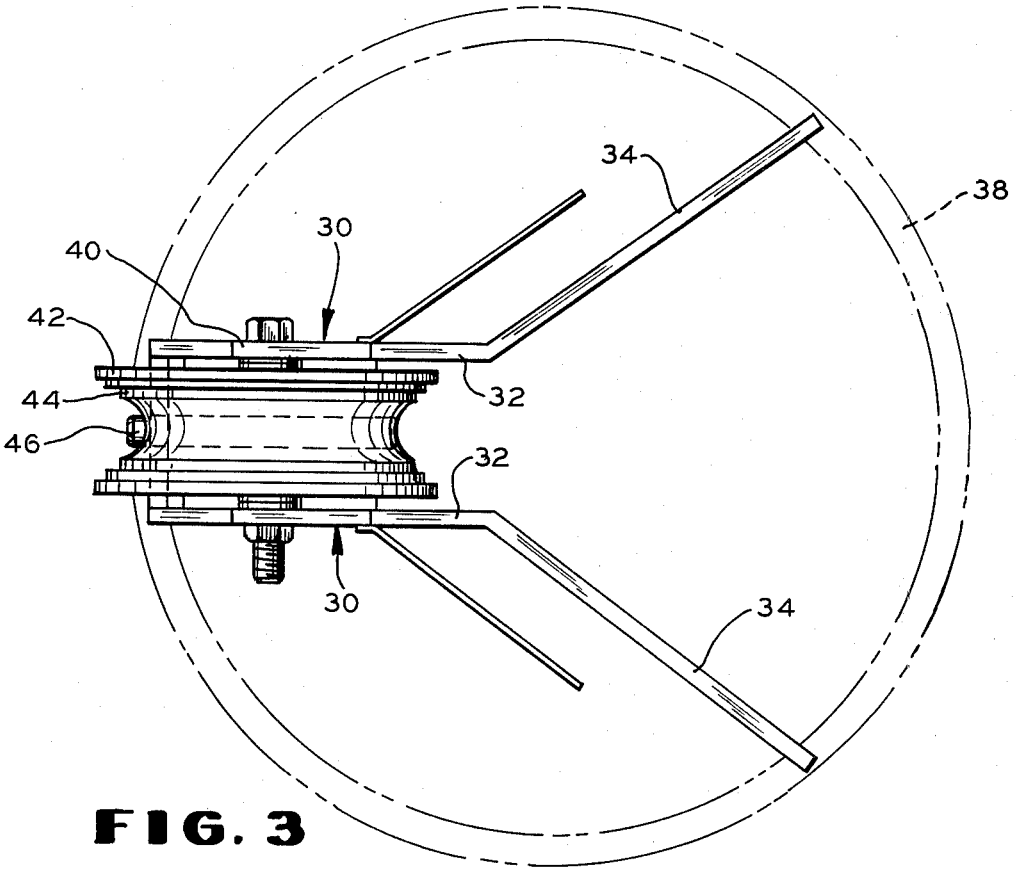
FIG. 3 is an enlarged plan view of a manhole hose guide of the present invention with the guide being shown in position on a manhole ring that is indicated by dot-dash lines.
Figure 4:
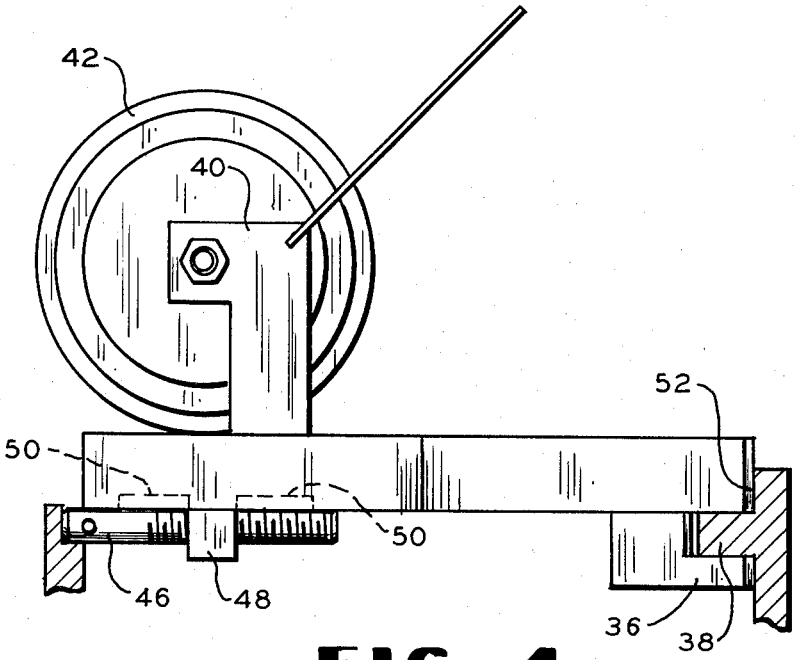
FIG. 4 is a side elevational view of the manhole and manhole hose guide shown in FIG. 3.

FIGS. 3 and 4 of the drawings show a guide structure uniquely suited to guide the hose down a manhole for proper entrance into the sewer guide of FIG. 2. The manhole guide shown in FIGS. 3 and 4 generally comprises a pair of frame members 30 having spaced apart parallel portions 32 having a length that generally corresponds to a radius of a manhole ring. One end of each parallel portion 32 is adpated to generally overlay one side of a manhole ring, and the other end of each frame members 30 is bent laterally so that they diverge from each other at an angle of approximately 70 degrees with their ends terminating over the manhole ring. The ends of the diverging portions 34 have hook portions 36 therebeneath, and which are so constructed so as to slip under the internal flange 38 of the manhole ring. The parallel portions 32 have upwardly extending brackets 40 welded to their top edges. A wheel 42 having a concave periphery 44 is suitably journaled between the upper ends of the brackets 40 at such a location that a hydraulic hose passing over the wheel will generally be centered in the manhole. The diverging portions 34 also serve to guide the hose towards the concave periphery of the wheel 42 when the hose is tensioned. A threaded pin 46 is mounted horizontally beneath the frames 30 by means of a threaded nut 48 that is welded to a pair of transverse plate members 50. The pin, of course, is threaded into the nut 48, and an unthreaded portion of the pin 46 projects outwardly beyond the ends of the parallel portion 32, so that the pin can sit down upon the internal flange 38 of a manhole ring and simultaneously abut the vertical edge 52 above the internal flange 38 which normally surrounds a manhole cover. The pulling action of the hose causes the end of the pin 46 to engage the surface 52 and prevent the hooks 36 from being pulled off of the internal flange of the manhole ring, so that the pressure and tensioning of the hydraulic hose is utilized to keep the guide assembly in place. The manhole guide is easily installed after the hose has been threaded down the manhole by putting the diverging legs 34 underneath the hose and pushing the manhole guide assembly forwardly into position wherein the hooks 36 are caught onto the internal flange 38 of the manhole ring. The hose automatically moves down into the proper position over the wheel 42 and downward force on the assembly causes the threaded pin 46 to be caught between the internal flange 38 and the vertical surface 52 of the manhole ring.

Whereas the prior part devices have required man power to properly feed the hydraulic hose down into the manhole. It is a feature of the present invention that the tensioning be done by the braking action of the hose reel itself. To this end, the traverse mechanism 14 has been redesigned to carry two spaced apart rollers 54 having concave peripheries that are rotatable about horizontal axes spaced at an oblique angle relative to each other. Since the rollers have a concave periphery, they can be spaced apart by a distance slightly greater than the diameter of the hydraulic hose without having the hose remain out of contact with one of the rollers for any appreciable period. Tensioning of the hose against either one of the rollers will accurately guide the hose, and a suitable handle on the frame of the traverse mechanism 14 can be used to swing the traverse mechanism to either side of the center line of the hose reel, while the hose remains guided by its engagement with one of the concave rollers 54. In some instances, the hose may be fed off of the hose reel 12 when the arm 16 is swung laterally to one side thereof. In this case, the hose will be held up against the bottom of the outer upper roller 54. The traverse mechanism 14 may include a pair of pin rollers 56 positioned outwardly of the rollers 54, and may also include a pair of horizontal pin rollers 58 beneath the concave rollers 54. In most instances, however, it will be highly desirable, particularly where the hose is being retrieved, to cause the hose to extend from the traverse mechanism around a load sheave 60 about to be described.

The load sheave 60 is mounted for rotation about an axis parallel to the longitudinal axis of the vehicle 10 with one side of the wheel being supported generally tangent to the plane passing through the vertical center line of the hose reel. The periphery of the load sheave 60 is concave so as to properly guide the hose. The load sheave 60 is positioned rearwardly of the truck by a proper distance so that it will support the hose in approximately a straight line condition with the traverse mechanism 14 and the top of the hose reel. A slight bow in the hose as it moves through the traverse mechanism 14 is desirable to hold its engagement with the lower concave roller 54; and since the load sheave is held in a fixed position at approximately the center line of the hose reel, the traverse mechanism can be easily pushed from one side to the other to thread the hose onto and off of the hose reel. The load sheave 60 is mounted on a stub shaft 62 which is in turn welded to the end of a square tube 64 which telescopes into a larger square tube 66 that in turn is welded to the internal frame of the vehicle 10. The telescoping square tubes 64 and 66 have holes passing therethrough for receiving a pin 68 to lock the load sheave longitudinally of the vehicle at the appropriate position. Since it is necessary that the load sheave extend rearwardly from the vehicle by a considerable distance, the construction of the load sheave is such that the pin can be removed and the load sheave moved up against the frame of the vehicle during transporting of the vehicle.

The significance of the structure so far described will best be apparent from an understanding of how it operates. Instead of having a work crew feed the hose from the reel in a sweeping bend and center it down the manhole, it is possible with the structure of the present invention, to utilize the friction brake on the hose reel to keep the hose properly tensioned all the way from the hose reel to the hydraulic jet down in the sewer being cleaned. The tensioning of the hose over the load sheave 60, and manhole sheave 42, keeps the hose properly centered in the manhole and the guide sheave frame properly locked in position on the manhole ring. At the same time, the tensioning of the hose against one or more rollers 22 of the sewer entry guide 20 keeps the hydraulic hose loosely positioned off of the bottom of the sewer being cleaned. A uniform tensioning of the hose up off of the bottom of the sewer obviates binding with respect to the sewer entry guide frame. This allows the portion of the hydraulic hose that extends into the sewer being cleaned to be under the same tension as elsewhere and allows the nozzle to better center itself in the sewer being cleaned. A better nozzle action, therefore, is to be expected.

Whereas it was very difficult with the prior art to "reverse clean" the sewer by pulling the hydraulic hose out of the sewer under pressure. This is greatly facilitated with the structure of the present invention. Since the hose is under uniform tension all the way from the hose reel to the hydraulic jet, all possibility of hose being rubbed over sharp edges is obviated. The hose can be wound up on the hose reel using power to slowly and uniformly withdraw the hydraulic jet. In order to perform this operation, the operator need only stand at the traverse mechanism and guide it to opposite sides of the center line of the hose reel; and when the hose passes over the load sheave 60, the hose will in most instances be pulled down tight against an adjacent coil so that it traverses itself forward and back across the hose reel in a uniform retrieving action. This is not the case with the prior art where the hose had to be man handled as it was retrieved.

It will be apparent that the objects heretofore enumerated, as well as others, has been accomplished; and that there has been provided a new and improved system for hydraulically cleaning sewers which overcomes the numerous disadvantages of the prior art, and some of which have been discussed above.

While the invention has been described in considerable detail, I do not wish to be limited to the particular embodiments shown and described; and it is my intention to cover hereby all novel adaptations, modifications, and arrangements thereof will come within the practice of those skilled in the art, and which fall within the purview of the following claims.

I claim:

1. A hydraulic hose sewer cleaning system and the like, comprising: a movable frame; a hose reel mounted with its axis generally horizontally of said frame; a first wheel positioned to one side of said hose reel, and supported from said frame about a generally horizontal axis that is generally perpendicular to the axis of said hose reel, and with a tangent to its periphery generally centered longitudinally of said reel, said wheel having a groove in its periphery for receiving a hydraulic hose; a generally Y-shaped frame having a base leg and two oblique legs, said oblique legs having hooks thereon for receiving an internal flange of a manhole and the like; a second wheel mounted generally above said base leg, said second wheel having a groove in its periphery for receiving a hydraulic hose from said first wheel and guiding it down a manhole between said oblique legs; and a traverse mechanism between said first wheel and said hose reel for guiding hose from said first wheel onto portions of said hose reel on opposite sides of said first wheel; and whereby hose can be fed vertically over said second pulley then laterally to said first wheel and uniformly coiled onto said hose reel.

2. The system of claim 1 wherein said traverse mechanism comprises first and second rollers having concave peripheries spaced apart obliquely at a distance greater than the diameter of the hose with the normal to the axis of said rollers extending generally tangentially to the hose reel; and means for moving said concave rollers back and forth with respect to said hose reel.

3. In a system for feeding and retrieving hose and the like to conduits through a manhole from a storage reel, the combination of guiding apparatus comprising: a first wheel located to one side of the storage reel and rotatable about a horizontal axis generally normal to the axis of the storage reel and positioned so that its periphery is generally tangent to the midpoint of the storage reel; a traverse mechanism between said first wheel and said storage reel; a frame for sitting on top of a manhole; a second wheel mounted on top of said frame about a generally horizontal axis, said wheels having concave peripheries, said frame having a pair of spaced apart hooks projecting away from said second wheel and arranged to slip under a flange of a manhole, and an opposing abutment fitting into the opposite side of the manhole to lock said frame in place when a hydraulic hose or the like is pulled out of a manhole over said second wheel to proceed laterally to and around said first wheel to the storage reel, and a conduit entrance guide having means for holding hose or the like guided by said guide off of the sides of the conduit, and whereby a pulling force on the hose or the like in said conduit holds the hose properly guided from the conduit to the storage reel and holds said frame and conduit entrance guide in proper feeding and retrieving position.

4. A hose retrieving apparatus for manholes, and the like comprising: two spaced apart members having parallel portions of a length approximately equal to the radius of a manhole ring, and divergent portions for spanning from the parallel portions to the internal shoulder of the manhole ring, said divergent portions having hooks on the bottom of their outer ends for engagement with the underside of the interior shoulder of the ring; an abutment carried by said parallel portions for sitting on the adjacent internal shoulder of the manhole and for engagement with its vertical rim, and a wheel having a concave periphery positioned over said parallel portions for rotation about a horizontal axis; and whereby the apparatus is locked in place by pulling action on the hose.

5. The apparatus of claim 4 wherein said abutment comprises: a projecting rod that is threadably carried by said frame with its projecting portion being adapted to both sit on the internal shoulder and abut the vertical rim of the menhole ring on which it sits.

6. The system of claim 3 wherein said opposing abutment is carried by said frame and is adapted to bear against the side of the manhole opposite said hooks and prevent said hooks from coming loose of the manhole.

* * * * *